United States Patent [19]

Hoffman

[11] Patent Number: 4,903,929

[45] Date of Patent: Feb. 27, 1990

[54] PORTABLE APPARATUS FOR HOLDING OBJECTS

[76] Inventor: Ronald W. Hoffman, 10431 W. Catalina, Phoenix, Ariz. 85039

[21] Appl. No.: 309,110

[22] Filed: Feb. 13, 1989

[51] Int. Cl.[4] ..... B25B 1/00

[52] U.S. Cl. ..... 248/229; 248/231.7; 24/335

[58] Field of Search ..... 248/540, 541, 102, 103, 248/207, 229, 231.7; 24/335, 336, 339, 525; 269/249, 97, 98, 254 R, 287

[56] References Cited

U.S. PATENT DOCUMENTS

| | | | |
|---|---|---|---|
| 454,553 | 6/1891 | Whitten | 248/207 |
| 649,115 | 5/1900 | Stevens . | |
| 824,149 | 6/1906 | Ruddell . | |
| 1,141,060 | 5/1915 | Hobbs . | |
| 1,213,645 | 1/1917 | Holden . | |
| 1,245,744 | 11/1917 | Liebner | 248/207 |
| 1,393,265 | 10/1921 | Cooper . | |
| 2,370,876 | 3/1945 | Richardson | 24/249 |
| 2,430,161 | 11/1947 | Csencsics | 248/226 A |
| 2,896,896 | 7/1959 | Revzin | 248/229 |
| 3,643,902 | 2/1972 | Gualano | 248/231.7 |
| 3,666,372 | 5/1972 | Lipkowski | 248/229 |
| 3,747,166 | 7/1973 | Eross | 248/229 |
| 4,190,224 | 2/1980 | LeBlanc | 248/229 |
| 4,747,590 | 5/1988 | Yang | 269/249 |

FOREIGN PATENT DOCUMENTS

| | | | |
|---|---|---|---|
| 440580 | 12/1967 | Switzerland | 248/231.7 |
| 466303 | 5/1937 | United Kingdom | 248/231.7 |

*Primary Examiner*—Alvin C. Chin-Shue
*Assistant Examiner*—Robert A. Olson
*Attorney, Agent, or Firm*—Don J. Flickinger; Jordan M. Meschkow; Lowell W. Gresham

[57] ABSTRACT

A holding device which clamps onto a wide variety of fixtures, such as furniture, pipes, counter tops, trees, rocks, fences, etc., and holds pole-shaped objects, such as billiards cues, gun barrels, fishing rods, measurement instruments, painting tools, etc., is disclosed. A C-clamp is formed from a plastic U-shaped member which movably couples to a plastic, pole-shaped member. The U-shaped member has a plurality of retained openings therein for selective installation of one or more retainers. A retainer press-fits into one of the retainer openings and is rotatable therein so that a wide variety of holding orientations may be achieved. The retainer includes an open, curved, resilient member which holds the pole-shaped object. The held object is installed by being pressed into the interior of the curved member at the opening thereof. Such pressing expands the curved member sufficiently so that the opening permits passage of the held object. Resilience of the curved member then urges the curved member to return to its quiescent shape. The held object is removed by being pulled out of the retainer through the opening therein.

12 Claims, 1 Drawing Sheet

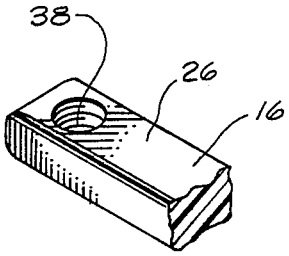
FIG. 3
FIG. 1
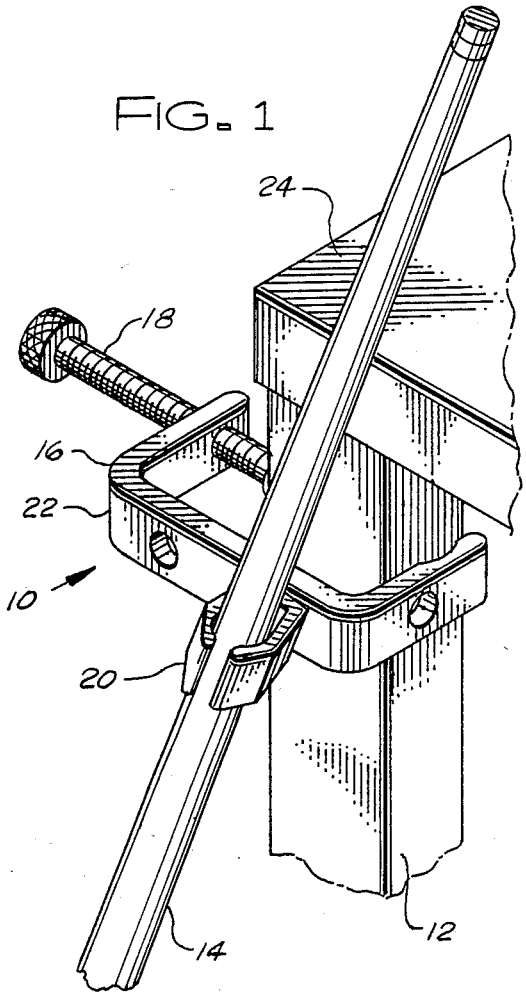
FIG. 2
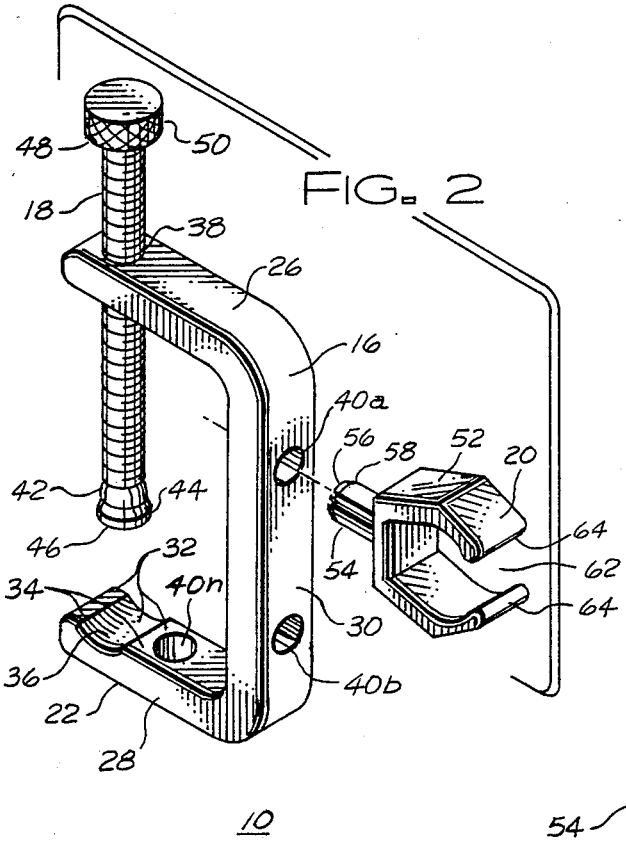
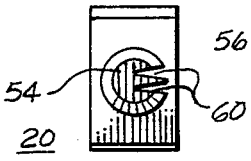
FIG. 4
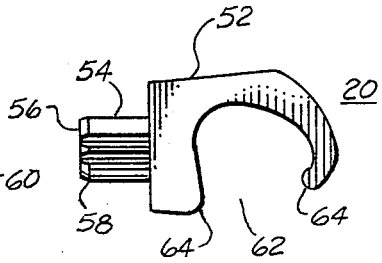
FIG. 5

PORTABLE APPARATUS FOR HOLDING OBJECTS

TECHNICAL FIELD OF THE INVENTION

The present invention relates generally to devices which are intended to hold objects in a confined area. More specifically, the present invention relates to such devices which are easily transportable and specifically adapted to retain pole-like objects.

BACKGROUND OF THE INVENTION

Those who possess expensive, delicate, or otherwise customized pole-like tools or objects, such as guns, fishing rods, pool/billiards cues, or the like, typically wish to hold such objects in a safe place when they are not being actively used so that the objects do not become damaged or contaminated. Likewise, those who have messy pole-like objects, such as painting tools, wish to hold such objects in a place and orientation so that they will not cause damage to their surroundings.

Generally speaking, conventional devices which are intended to hold pole-like objects, such as guns, pool/-billiards cues, or painting tools, satisfactorily confine such objects. However, such conventional devices are often permanently installed at a location near where such objects are typically used or stored for lengthy periods of time. Consequently, when the pole-like objects or tools are actually used in a location remote from such permanently-installed holding devices, such permanently-installed holding devices fail to adequately serve containment needs for the pole-like objects.

Similarly, the conventional holding devices often hold a plurality of pole-like objects. When expensive, delicate, or otherwise customized pole-like objects or tools are used near such multiple-object holders, the owners of such objects nevertheless often desire to hold them apart from other less expensive, less fragile, or more common pole-like objects or tools confined in the multiple-object holders. This segregation prevents others from attempting to use the object and protects the object from potential harm. However, the multiple-object holders fail to permit such segregated confinement.

Moreover, conventional "carrying case" type holding devices are often designed for transporting individual objects and for holding such objects for lengthy periods of time. Installation and removal from such cases is often a cumbersome process, and such cases are typically difficult to transport separately from the objects they are designed to hold. Consequently, they fail to serve the need of holding an object during temporary inactive periods which occur while such objects are being used.

SUMMARY OF THE INVENTION

Accordingly, it is an advantage of the present invention that a holding device which is easily transportable separately from the object it is designed to confine is provided. Thus, the present invention may be carried on the person of a user while the object is actively being used.

Another advantage of the present invention is that it easily and temporarily attaches to existing fixtures, such as furniture, pipes, counters, trees, rocks, fences, and the like. Thus, it may be located in a wide variety of locations near where the object it is designed to confine is to be used.

Yet another advantage is that the present invention allows quick installation and removal of an object therefrom. Thus, the present invention suitably confines the object for brief, intermittent inactive periods which occur while the object is being used.

Still another advantage is that the present invention is adjustable so that the object which it confines may be positioned in a desired orientation near the fixture to which the present invention attaches. Thus, the object may be oriented to minimize the possibility of being damaged.

The above and other advantages of the present invention are carried out in one form by an apparatus which includes a first member, a second member, and a retaining device. Each of the first and second members has a gripping surface, and the first and second members movably couple together so that the distance between the gripping surfaces may be varied. Consequently, the first and second members collectively operate as a clamp which may be installed onto a fixture. The retaining device couples to the first member so that it effectively confines an object to be held by the present invention.

BRIEF DESCRIPTION OF THE DRAWINGS

A more complete understanding of the present invention may be derived by referring to the detailed description and claims when considered in connection with the FIGURES, wherein like reference numbers refer to similar items throughout the FIGURES, and:

FIG. 1 shows a perspective view of the present invention in use with a pole-like object and a fixture;

FIG. 2 shows an exploded perspective view of the present invention;

FIG. 3 shows a perspective view of a top-arm portion of a U-shaped member of the present invention;

FIG. 4 shows an end view of a retainer portion of the present invention; and FIG. 5 shows a side view of a second embodiment of the retain portion of the present invention.

DETAILED DESCRIPTION OF THE PREFERRED EMBODIMENTS

FIG. 1 shows a portable holding device 10 installed relative to a fixture 12. In addition, FIG. 1 shows a pole-shaped object 14 confined in holding device 10. Although FIG. 1 illustrates fixture 12 as being a table leg, it is to be understood that fixture 12 may alternately represent a wide range of objects, such as furniture, pipes, counters, window sills, trees, rocks, fences, and the like. Specifically, fixture 12 need only be sufficiently stable to support object 14 and have a projection of suitable dimensions for attachment of holding device 10. Likewise, although FIG. 1 illustrates pole-shaped object 14 as being a billiards cue, it is to be understood that object 14 may alternately represent a wide range of pole-shaped objects, such as gun barrels, fishing rods, measurement instruments, painting or other tools, and the like.

Holding device 10 includes a U-shaped member 16, a pole-shaped member 18, which couples to U-shaped member 16, and a retainer 20, which also couples to U-shaped member 16. U-shaped member 16 and pole-shaped member 18 together form a C-clamp 22 which operates to grip fixture 12. In the preferred embodiment, C-clamp 22 is relatively small (approximately 4"×2"×½") so that it can be easily transported among the personal effects of a user.

The material utilized in constructing C-clamp 22 is not critical in the present invention, and may be steel when specific applications for holding device 10 require relatively large clamping forces. However, the preferred embodiment of the present invention contemplates that C-clamp 22 be constructed using molded plastic members. The use of plastic reduces the weight of holding device 10 and therefore promotes the portability of holding device 10. In addition, the use of plastic prevents holding device 10 from damaging furniture-like fixtures 12 to which it may be attached because only a relatively small clamping force can be generated when compared to a steel C-clamp.

FIG. 1 additionally illustrates a holding orientation of retainer 20 as being approximately aligned with the clamping direction of C-clamp 22. Specifically, retainer 20 is oriented so that object 14 extends in a generally vertical direction, and C-clamp 22 is oriented so that it clamps to a generally vertical table leg. This orientation represents only one of a wide variety of relative orientations which may be achieved by the present invention. In fact, retainer 20 rotates relative to C-clamp 22 so that any angle can be achieved. For example, if C-clamp 22 were attached to a horizontal surface, such as a table top 24 of fixture 12, then retainer 20 could rotate 90° so that object 14 would reside in substantially the same orientation as is shown in FIG. 1.

FIG. 2 shows an exploded view of holder 10. U-shaped member 16 of holder 10 includes top and bottom arms 26 and 28, respectively, which are spaced apart by a middle arm 30. Arms 26–30 are integrally formed into a single unit. A gripping surface 32 of member 16 resides on the interior side of bottom arm 28. Gripping surface 32 includes a flat portion 34, which conforms to flat surfaces of fixture 12. Consequently, when holder 10 is attached to fixture 12, clamping forces are distributed over a relatively wide area. In addition, gripping surface 32 includes a curved portion 36 which resides at a concave indentation into bottom arm 28 at surface 32. Curved portion 36 conforms to fixture 12 when fixture 12 has a curved perimeter, such as a pipe or a table with round legs (not shown). Thus, clamping forces are again distributed over a relatively wide area. The distribution of clamping forces over a relatively wide area prevents the clamping forces from damaging fixture 12 while simultaneously insuring against slippage of holder 10 relative to fixture 12.

As shown in FIGS. 2–3, Top arm 26 of U-shaped member 16 has a threaded, circular hole 38 therethrough at a location which opposes curved portion 36 of gripping surface 32. Pole-shaped member 18 exhibits a cross-sectional area and threads complementary to hole 38 in arm 26. Consequently, pole-shaped member 18 couples to U-shaped member 16 at hole 38 and is movable relative to U-shaped member 16 by being screwed into or out of hole 38.

A bottom end 42 of pole-shaped member 18 contains a force distribution cap 44, which is attached at a swivel joint (not shown) between cap 44 and pole-shaped member 18 at bottom end 42. Cap 44 has a flat gripping surface 46 which opposes gripping surface 32 and contacts fixture 12 when holding device 10 attaches thereto (see FIG. 1). Gripping surface 46 exhibits a larger area than the cross-sectional area of pole-shaped member 18. Consequently, gripping forces applied to fixture 12 (see FIG. 1) between gripping surfaces 32 and 46 are distributed over a wider area than the cross-sectional area of member 18 to minimize the possibility of damage to fixture 12.

A top end 48 of pole-shaped member 18 contains a knurled handle 50. Handle 50 provides a slip resistant surface for convenient gripping by a user of holding device 10 to facilitate hand-operated rotation of pole-shaped member 18 relative to U-shaped member 16. Of course, such rotation causes the clamping distance between gripping surfaces 32 and 46 to vary.

U-shaped member 16 additionally has a plurality of retainer openings **40*a*, 40*b*, . . . 40*n* therethrough. FIG. 2 shows retainer openings 40*a* and 40*b* through middle arm 30 and retainer opening 40*n* through bottom arm 28. Retainer openings 40*a*–40*n* are circular openings which are identically dimensioned and are used for coupling retainer 20 to U-shaped member 16. Consequently, retainer 20 may couple to a selected one of retainer openings 40*a*–40*n* to achieve a desired orientation of object 14 relative to fixture 12 (see FIG. 1). Alternatively, multiple ones of retainer 20 can be coupled to U-shaped member 16 at retainer openings 40*a*–40*n* so that multiple objects 14 may be held by holder 10** or so that a wider variety of holding orientations are readily available.

Retainer 20 has an open, curved member 52 integrally formed with a plug 54 into a single unit. The material which forms retainer 20 is not critical in the present invention and may advantageously be a rigid plastic similar or identical to the material used in forming C-clamp 22. Specifically, such material is relatively rigid but sufficiently resilient so that it returns to a quiescent shape after being deformed away from the quiescent shape, even after repeated deformations.

As shown in FIGS. 2 and 4, plug 54 of retainer 20 roughly represents a cylindrically shaped object of sufficient length to extend a substantial distance into a selected one of retainer openings **40*a*–40*n*, hereinafter referred to as opening 40. An insertion end 56 of plug 54 exhibits a diameter which is slightly smaller than the diameter of opening 40. However, plug 54 tapers outward from insertion end 56 as it extends toward curved member 52. At a point 58, the diameter of plug 54 is slightly greater than the diameter of opening 40. Plug 54 exhibits a substantially invariant diameter from point 58 to curved member 52**.

Retainer 20 couples to U-shaped member 16 by the insertion of insertion end 56 of plug 54 into opening 40. The tapered portion of plug 54 contacts the walls of U-shaped member 16 which surround opening 40. Then, continued movement of plug 54 into opening 40 causes plug 54 to compress away from its quiescent shape. Such compression is permitted by the shrinkage of void channels 60 (see FIG. 4), which extend the length of plug 54. After insertion, the resilience of plug 54 urges plug 54 to expand within opening 40. Thus, retainer 20 is secured within opening 40 by frictional clamping forces between plug 54 and the walls of U-shaped member 16 which surround opening 40. Retainer 20 may be removed from opening 40 by applying sufficient outward force to overcome such frictional clamping forces.

FIGS. 1–2 illustrate a first embodiment of retainer 20. In this first embodiment, an opening 62 in circular member 52 faces 180° away from plug 54. FIG. 5 illustrates a second embodiment of retainer 20. The second embodiment is similar to the first embodiment except that in the second embodiment opening 62 faces 90° away from plug 54. Consequently, a selected one of the first and second embodiments of retainer 20 may be used to achieve a desired holding orientation. In fact, a first embodiment of retainer 20 and a second embodiment of retainer 20 may simultaneously couple to C-clamp 22 so that a wide variety of holding orientations are readily available to a user.

In each of the first and second embodiments, opening 62 is smaller than the diameter of pole-shaped object 14 (see FIG. 1) when curved member 52 is in its quiescent shape. In addition, ends 64 of curved member 52, which ends 64 reside on opposing sides of opening 62, are curved or tapered. When object 14 is urged toward the interior of curved member 52 at opening 62, this taper causes curved member 52 to deflect away from its quiescent shape. Such deflection expands opening 62 to allow passage of object 14 therethrough. Once the diameter of pole-shaped object 14 passes through opening 62 and resides within the interior of curved member 52, the resilience of curved member 52 causes a return toward the quiescent shape. Such return causes curved member 52 to grip or at least confine object 14 within the interior of curved member 52.

Object 14 may be removed from retainer 20 simply by pulling object 14 outward from curved member 52 through opening 62. Of course, the amount of force required to remove object 14 from retainer 20 is substantially less than the amount of force required to remove retainer 20 from C-clamp 22. Thus, retainer 20 remains coupled to C-clamp 22.

In summary, the present invention provides a holding device which is small and lightweight so that it can be easily transported. The present invention adjusts to provide a wide variety of holding orientations so that the held object may be desirably positioned relative to a wide variety of fixture structures. The present invention utilizes a clamping function so that it quickly and temporarily attaches to fixtures. In addition, the held object is quickly installed and removed from the present invention. Consequently, the present invention is convenient for temporary use applications.

The present invention has been described above with reference to preferred embodiments. However, those skilled in the art will recognize that changes and modifications may be made in these preferred embodiments without departing from the scope of the present invention. For example, the present invention contemplates the use of alternate clamping devices other than the specific C-clamp described above. In addition, those skilled in the art may devise alternate techniques for coupling the above-discussed retainer and C-clamp. These and other changes and modifications which are obvious to those skilled in the art are intended to be included within the scope of the present invention.

What is claimed is:

1. A portable holding apparatus for supporting a pole-shaped object, said apparatus comprising:

(a) a first member having a gripping surface;

(b) a second member having a gripping surface, said second member being movably coupled to said first member so that a distance between said first member gripping surface and said second member gripping surface varies to clamp a fixture between said first and second member gripping surfaces; and (c) retaining means including (i) an open, resilient curved member extending away from said first member for receiving and gripping said pole-shaped object, said member having opposing sides for surrounding said object, said curved member being compressible from an expanded position in which said sides are sufficiently far apart to allow installation and removal of said pole-shaped object to a quiescent position in which said sides are sufficiently close together to grippingly confine said pole-shaped object, and (ii) snap-in connection means comprising a retainer opening formed in said first member, said retainer opening being surrounded by an opening wall; and a plug member coupled to said curved member, said plug member being dimensioned to conform with said retainer opening and being formed from a deformable, resilient material which compresses away from a quiescent shape during installation into said retainer opening and which expands after installation to substantially fill said retainer opening, thereby creating sufficient frictional clamping forces between said plug and said wall to rotatably retain said plug in said retainer opening.

2. A holding apparatus as claimed in claim 1 wherein said first member is configured so that said retaining means selectively couples to said first member at any one of a plurality of preselected positions thereon.

3. A holding apparatus as claimed in claim 1 wherein each of said first and second members are formed from molded plastic components.

4. A holding apparatus as claimed in claim 1 wherein said first and second members operate together to form a C-clamp.

5. A holding apparatus as claimed in claim 1 wherein:

said first member comprises a U-shaped, rigid structure integrally formed to include first and second opposing arms spaced apart by a middle arm so that said gripping surface resides on an interior side, with respect to said U-shaped structure, of said first arm, said U-shaped structure second arm having a threaded, circular opening therethrough;

said second member comprises a threaded, rigid, pole-shaped structure having first and second ends, said pole-shaped structure first end serving as said second member gripping surface, and said pole-shaped structure being rotatably coupled to said first member at said circular opening; and said second member additionally comprises means, coupled to said pole-shaped structure proximate said second end thereof, for hand-operated rotation of said pole-shaped structure relative to said U-shaped structure.

6. The portable holding apparatus as claimed in claim 1, further comprising a plurality of void channels extending longitudinally along said plug to aid compression of said plug away from said quiescent shape during insertion of said plug into said retainer opening.

7. A holding apparatus as claimed in claim 1 wherein said first member gripping surface comprises a flat portion so that said first member gripping surface conforms to said fixture when said fixture has a flat perimeter.

8. A holding apparatus as claimed in claim 7 wherein said first member gripping surface additionally comprises a concave indentation with respect to said first member so that said first member gripping surface conforms to said fixture when said fixture has a curved perimeter.

9. The portable holding apparatus of claim 1, wherein:

(a) said first member comprises a U-shaped rigid structure integrally formed to include first and second opposing arms spaced apart by a middle arm so that said gripping surface residues on an interior side, with respect to said U-shaped structure, of said first arm, said U-shaped structure second arm having a threaded, circular opening therethrough;

(b) said second member comprises a threaded, rigid, pole-shaped structure having first and second ends, said pole-shaped structure first end serving as said second member gripping surface, and said pole-shaped structure being rotatably coupled to said first member at said circular opening; and (c) said second member additionally comprises means, proximate said second end thereof, for hand-operated rotation of said pole-shaped structure relative to said U-shaped structure.

10. The portable holding apparatus of claim 9, wherein said retainer opening extends through said middle arm of said first member.

11. The portable holding apparatus of claim 10, further comprising a second retainer opening extending through one of said first and second arms so that said retaining means couples to said U-shaped structure at a selectable one of said first and second holes.

12. The portable holding apparatus of claim 11, further comprising a third retainer opening extending through said middle arm so that said retainer means couples to said U-shaped structure at a selectable one of said first, second, and third holes.

* * * * *